US006006630A

United States Patent [19]

Vasichek et al.

[11] Patent Number: 6,006,630

[45] Date of Patent: Dec. 28, 1999

[54] MAGNETIC KEEPER ACCESSORY FOR WRENCH SOCKETS

[75] Inventors: Richard A. Vasichek, Brocket; Robert J. Vasichek, Michigan, both of N. Dak.; Gregory J. Grote; Paul D. Sigaty, both of Aberdeen, S. Dak.

[73] Assignee: Vasichek Enterprises LLC, Brocket, N. Dak.

[21] Appl. No.: 08/919,596

[22] Filed: Aug. 12, 1997

[51] Int. Cl.[6] ..... B25B 13/02

[52] U.S. Cl. ..... 81/125

[58] Field of Search ..... 81/125

[56] References Cited

U.S. PATENT DOCUMENTS

| | | | |
|---|---|---|---|
| D. 369,075 | 4/1996 | Vasichek et al. . | |
| 2,491,089 | 12/1949 | Cowden . | |
| 2,551,553 | 5/1951 | Wahl . | |
| 2,624,223 | 1/1953 | Clark . | |
| 2,750,828 | 6/1956 | Wendling . | |
| 2,778,669 | 1/1957 | Goodwin . | |
| 2,793,552 | 5/1957 | Clark . | |
| 2,806,396 | 9/1957 | Miller . | |
| 3,240,087 | 3/1966 | Estes . | |
| 3,288,002 | 11/1966 | Mankovitz . | |
| 3,320,563 | 5/1967 | Clark . | |
| 3,392,767 | 7/1968 | Stillwagon, Jr. . | |
| 3,630,108 | 12/1971 | Stillwagon, Jr. . | |
| 3,707,894 | 1/1973 | Stillwagon, Jr. . | |
| 3,731,722 | 5/1973 | Carr . | |
| 3,808,918 | 5/1974 | Carr . | |
| 3,834,253 | 9/1974 | Carr . | |
| 3,835,737 | 9/1974 | Carr . | |
| 3,869,945 | 3/1975 | Zerver . | |
| 4,663,998 | 5/1987 | Parsons et al. . | |
| 5,146,814 | 9/1992 | Vasichek | 81/125 |
| 5,199,334 | 4/1993 | Vasichek et al. . | |
| 5,277,088 | 1/1994 | Vasichek et al. . | |
| 5,542,320 | 8/1996 | Vasichek et al. | 81/125 |
| 5,603,248 | 2/1997 | Eggert et al. | 81/125 |

FOREIGN PATENT DOCUMENTS

| | | | |
|---|---|---|---|
| 416418 | 12/1994 | Germany . | |
| 19607936 | 11/1996 | Germany . | |
| 29707519 | 7/1997 | Germany . | |
| 818530 | 8/1959 | United Kingdom | 81/125 |

OTHER PUBLICATIONS

Williams, "Hold–A–Nut", Williams Manufacturing, 1994.

*Primary Examiner*—David A. Scherbel
*Assistant Examiner*—Daniel G. Shanley
*Attorney, Agent, or Firm*—L. MeRoy Lillehaugen; Alan D. Kamrath; Oppenheimer Wolff & Donnelly LLP

[57] ABSTRACT

An accessory (10) for a wrench socket (12) is disclosed including a generally cylindrical magnet (32) secured to a generally cylindrical, nonmagnetic, compressible disk (26) which snugly fits within the well (14) and magnetically insulates the magnet (32) from the socket (12). Specifically, the magnet (32) is received in a frustoconical recess (46) formed in the disk (26) while its temperature is elevated allowing the disk material to flex and stretch during the insertion of the magnet (32) into the recess (46). The magnet (32) is nickel-plated (43) and its corners are beveled (41) for ease of insertion of the magnet (32) into the recess (46). Air is received within a pocket (51) extending from the recess (46) and/or vented to the atmosphere through a vent hole (53) as the magnet (32) is forced into the recess (46). The accessory (10) is removably insertable into the socket (12) of any design and model and without need for modification of the socket (12) and captures a fastener (16) slideably received in the well (14) of the socket (12) to magnetically hold the fastener (16) captive in the well (14) as the socket (12) is moved to the fastening location while not magnetizing the socket (12) or the fastener (16) sufficiently to be detrimentally magnetically attracted to metal adjacent to the fastening location. In the most preferred form, a set of multiple accessories (10) are interconnected together by strips (62) integrally extending between the disks (26) for ease of fabrication and packaging but which can be manually broken to allow separation.

22 Claims, 1 Drawing Sheet

MAGNETIC KEEPER ACCESSORY FOR WRENCH SOCKETS

BACKGROUND

The present invention relates generally to accessories for tools for initially holding fasteners thereto, and particularly to accessories for wrench sockets for initially holding fasteners captive therein and their method of fabrication.

While installing fasteners, it is often desirable to maintain the fastener with the tool until fastening is initially underway. Often it was necessary to hold the fastener relative to the tool with one hand while the tool was manipulated with the other hand. Because of limitations in space, access to the fastener by the hand holding the fastener and also by the tool itself was difficult if not impossible. Furthermore, due to the proximity of the hand to the fastener and the tool, the hand initially holding the fastener to the tool was especially prone to accidental injury. Thus, there is a well known need in the art for methods for temporarily holding the fastener to the tool until the fastening is initially underway.

Prior to the present invention, several methods have been devised for the use of magnetic forces to retain fasteners to the tool during fastening or removal of the fasteners. However, acceptance of such prior approaches in the art has been limited due to the inherent deficiencies in such prior approaches. For example, many of such approaches required specially manufactured and designed tools to incorporate the fastener retention feature and thus could not be utilized when the fastener retention feature was not desired and could not be utilized with standard tools already in use. Further, many of such approaches magnetized the entire tool so that the tool was not only magnetically attracted to the fastener but also to any metal in the path of the tool to the fastening location as well as metal surrounding the fastening location. Furthermore, many of such approaches were of complicated, multipiece designs incapable of being economically manufactured and assembled. Although U.S. Pat. Nos. 5,146,814; 5,199,334; 5,277,088 and 5,542,320 represent a major advance in overcoming the inherent deficiencies in prior approaches, a continuing need exists for accessories which can be selectively utilized with conventional wrench sockets without modification thereto and which capture fasteners in the well of the socket.

It is thus an object of the present invention to provide a novel accessory for use in a wrench socket without need for modifying the wrench socket and for preventing fasteners from sliding from the well of the socket to hold the fastener captive in the well while the socket is being moved to the fastening location and while the fastener is being initially fastened. In this regard, such a tool will be especially helpful in assembling or disassembling goods in hard-to-get-at fastening locations and at greater efficiencies. Further, as many accidents happen when working in such hard-to-get-at fastening locations, the accessory will reduce the exposure of injury to the user's hand which was otherwise required to hold the fastener in the wrench socket. Furthermore, the accessory will reduce the chance of injury due to sharp threads cutting fingers holding the fastener while trying to initially thread such fasteners. Likewise, the accessory will allow persons having handicaps or other disabilities to utilize wrench sockets in fastening situations which they otherwise were unable to perform.

It is further an object of the present invention to provide such a novel accessory which captures the fastener in the well of the socket but also does not magnetize the socket or the fastener captured therein to such a degree to cause detrimental attraction of the socket and the fastener to metal surrounding the fastening location. For example, the socket and fastener will not be attracted to the metal block of an engine as it is moved adjacent thereto to the fastening location. In this regard, the accessory will increase efficiency and productivity. Specifically, the fastener is captured in the socket in a desired position and will not change orientation and/or fall therefrom due to gravitational forces. Thus, fasteners are easier to start with one hand operation, which is particularly desirable for use with pneumatic or electric speed wrenches.

SUMMARY

Surprisingly, the above objectives can be satisfied in the field of wrench sockets by providing, in the preferred form, an insert accessory for use in a conventional wrench socket without modification. The accessory includes a magnet secured to a nonmagnetic disk in its preferred form by its receipt in a recess formed in the disk. The magnet is smaller than the well of the socket. The disk snugly fits within the well of the socket and magnetically insulates the magnet from the socket.

In other aspects of the present invention, the magnet is held in the recess of the nonmagnetic disk without requiring the use of glue or adhesive by having the side wall of the recess including a portion of a size smaller than the generally constant size of the periphery of the magnet.

In further aspects of the present invention, the recess is axially offset from the center of the larger size disks so that the magnet held therein will engage at least a portion of a burr and will not be located concentrically within the center opening of the burr.

In still other aspects of the present invention, the magnet is forced into the recess formed in the disk while the disk is at an elevated temperature below the material melting temperature and permanent deformation softening temperature but sufficient to allow the material to flex and stretch during the insertion of the magnet.

In additional aspects of the present invention, a pocket extends from the lower wall of the recess which receives the magnet, with air trapped in the recess as the magnet is forced into the recess being received and compressed in the pocket. Alternately or in addition, air trapped in the recess as the magnet is forced into the recess is received in and allowed to escape from the recess through a vent hole.

In other aspects of the present invention, the corners of the magnet between the faces and the periphery are beveled for camming the disk outward when the magnet is forced into the recess. Alternately or additionally, the magnet is plated with a material such as nickel to reduce the sliding frictional forces between the magnet and disk as the magnet is forced into the recess, with the material also retarding rusting of the magnet in the most preferred form.

In still other aspects of the present invention, multiple accessories are interconnected together by integral strips formed of continuous, homogeneous material as the disks, with the strips retaining the disks together for fabrication and packaging of the accessories but can be manually broken to allow separation of the individual accessories for use.

In further aspects of the present invention, the nonmagnetic disk has first and second portions integrally attached together, with the periphery of the second portion being smaller than the periphery of the first portion and for receipt in the connection passage of the socket located intermediate the well and the handle mounting end.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
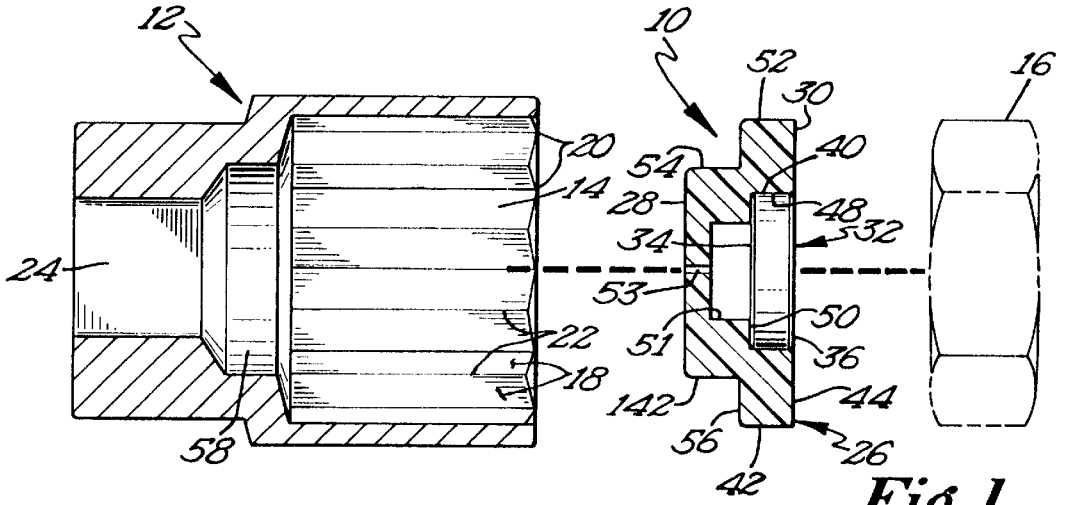
FIG. 1 shows an exploded, cross sectional view of a fastener-keeping accessory for wrench sockets according to the preferred teachings of the present invention, with a burr shown in phantom and exploded therefrom.
Figure 2:
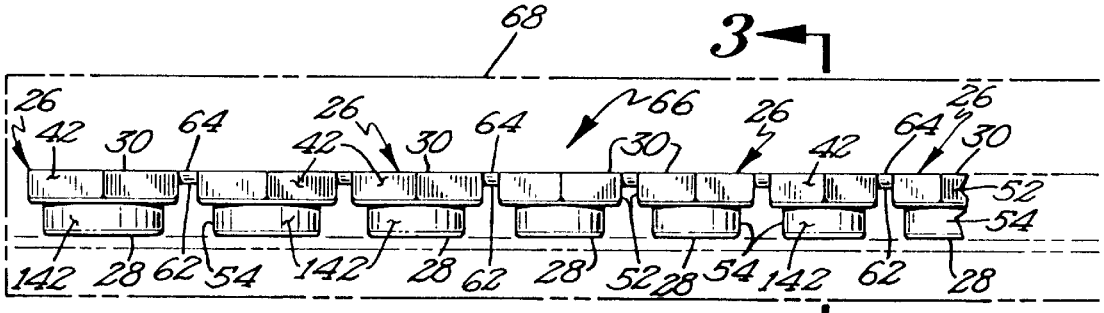
FIG. 2 shows a partial, side elevational view of the method of manufacture of the fastener-keeping accessory of FIG. 1, with portions shown in phantom.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "first", "second", "inside", "outside", "inner", "outer", and similar terms are used herein, it should be understood that these terms have reference only to the structure shown in the drawings as it would appear to a person viewing the drawings and are utilized only to facilitate describing the illustrative embodiment.

DESCRIPTION

An accessory for temporarily holding or keeping fasteners such as burrs or bolts captive with respect to a tool according to the preferred teachings of the present invention is shown in the drawings and generally designated 10. In the most preferred form, accessory 10 is utilized in conjunction with a tool in the form of a wrench socket 12. Socket 12 can be any standard design generally including a well 14 having a multisided periphery sized to axially slideably receive the corresponding sized head of a bolt, a burr, or like fastener 16 without allowing rotation of burr 16 relative thereto. Specifically, the outer ends of sides 18 forming well 14 intersect at corners 20 arranged at a diameter generally equal to the corners of burr 16 and the inner ends of sides 18 forming well 14 intersect at corners 22 arranged at a diameter less than the diameter of corners 20 or the corners of burr 16. Opposite well 14, socket 12 includes a handle mounting end including a noncircular opening 24 for slideably receiving a complementary shaped shank of any conventional wrench handle.

It should further be appreciated that some sockets 12 are manufactured with wells 14 of a shallow design and specifically do not extend the length of socket 12 to opening 24 but rather a connection tunnel or passage 58 is provided intermediate well 14 and opening 24. Passage 58 can have a variety of shapes but has a diameter less than well 14 and typically larger than opening 24. Sockets 12 of the type having such a connection passage 58 are commonly used in small size sockets 12 (i.e. having wells 14 for receipt of fasteners 16 having a cross sectional size of ½ inch (1.26 cm) or smaller) as well as by some manufacturers for larger size sockets 12.

In the preferred form shown, accessory 10 includes a disk 26 of uniform thickness having planar, parallel, opposed faces 28 and 30, with faces 28 and 30 each lying in a single plane in the most preferred form. In the most preferred form, disk 26 includes a first portion 52 integrally attached to a second portion 54. Portion 52 includes face 30 and has periphery 42 having a size at least equal to well 14 such as greater than the diameter of corners 22 and in the most preferred form, generally equal to or slightly smaller than the diameter of corners 20. In the preferred form, periphery 42 has hexagonal cross sections similar to but slightly larger than the typical hexagonal cross sections of burr 16 intended to be received in socket 12. Portion 54 includes face 28 and has a periphery 142 having a diameter less than portion 52. Portion 54 is of a generally cylindrical shape and in the most preferred form having circular cross sections arranged concentrically with portion 52. A shoulder 56 is formed by portion 52 extending radially beyond portion 54 at their interconnection.

Disk 26 is formed of suitable resilient, compressible, and nonmagnetic material of a flexible nature to allow portion 52 of disk 26 to be forced into well 14 with the outer periphery 42 elastically deforming to pass around corners 22 and snuggly fit within well 14. In its most preferred form, disk 26 is formed of low density polyethylene having a melting temperature of about 300° F. (150° C.) and which softens resulting in permanent deformation at about 220° F. (105° C.). Further, the fit of portion 52 of disk 26 should be such that disk 26 can be forced from well 14 by passing an elongated member through opening 24 and pushing against face 28 but preventing disk 26 from being shaken out of well 14 even after repeated insertions and removals from well 14.

Accessory 10 further includes a magnet 32 which in the preferred form is a ceramic or neodymium magnet. However, for accessory 10 to be utilized in sockets 12 having wells 14 for receipt of fasteners 16 having cross sectional sizes of ⅞ inch (2.22 cm) or smaller, magnet 32 may be formed of neodymium or rare earth elements due to the limited size requirements and/or due to magnetic strength requirements. In the preferred form, magnet 32 is of uniform thickness having planar, parallel, opposed faces 34 and 36, with faces 34 and 36 each lying in a single plane in the most preferred form. Further, magnet 32 has a periphery 40 of a generally cylindrical shape having circular cross sections of a constant diameter less than disk 26 and less than the diameter of corners 22 of well 14. In the most preferred form, the corners between faces 34 and 36 and periphery 40 are beveled as at 41. Additionally, in the most preferred form, magnet 32 includes a nickel-plating 43 to prevent rusting.

In the most preferred form, magnet 32 is permanently secured to disk 26 according to the teachings of the present invention with periphery 40 of magnet 32 being spaced from peripheries 42 and 142 of disk 26 with annular portion 44 of face 30 of disk 26 extending beyond periphery 40 of magnet 32 according to the preferred teachings of the present invention. In the preferred form shown, disk 26 includes recess 46 extending at a depth from face 30 towards but spaced from face 28 and spaced from peripheries 42 and 142. Recess 46 has a size and shape complementary to and for receipt of periphery 40 of magnet 32. Specifically, in the preferred form, recess 46 has a side wall 48 terminating in a lower wall 50 spaced from and parallel to face 30 and located intermediate faces 28 and 30. Side wall 48 has a first portion spaced from lower wall 50 of a size smaller than the generally constant size of periphery 40 of magnet 32, with recess 46 having an increasing size from the first portion with increased spacing from face 30. Specifically, in the most preferred form, the first portion is located generally contiguous with face 30 of disk 26. Additionally, side wall 48 is frusto shaped and specifically is frustoconical shaped in the most preferred form with periphery 40 of magnet 32 having a cylindrical shape with circular cross sections. The size of recess 46 at face 36 is less than the size of magnet 30 at face 36 and in the most preferred form is approximately 88% of the size of magnet 30 at face 36. The size of recess 46 at wall 50 is generally equal to the size of magnet 32 at face 34 in the preferred form but could be slightly larger than the size of magnet 32 at face 34. In the most preferred form, the corner between face 30 and side wall 48 could be beveled or rounded as at 49 to assist forcing magnet 32 into recess 46. In the preferred form shown, the depth of recess 46 between face 30 and lower wall 50 is generally equal to or slightly greater than the height of magnet 32 between faces 34 and 36, less than the height of disk 26 between faces 28 and 30 but greater than the height of portion 52 from face 30 to shoulder 56.

Figure 3:
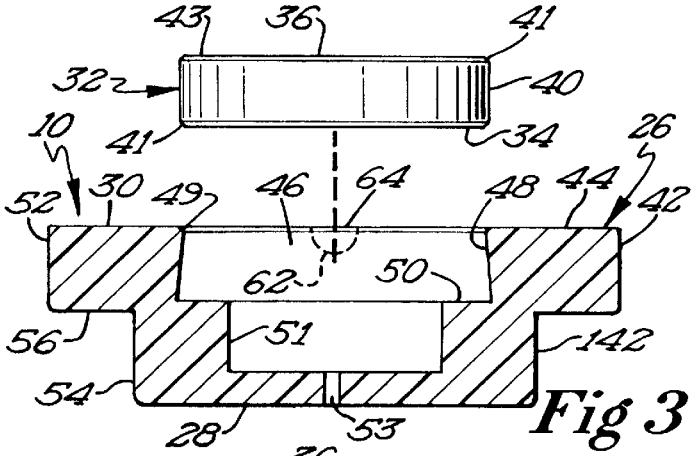
FIG. 3 shows a cross-sectional view of the fastener-keeping accessory of FIG. 1 according to section line 3—3 of FIG. 2 with a magnet exploded therefrom.
Figure 4:
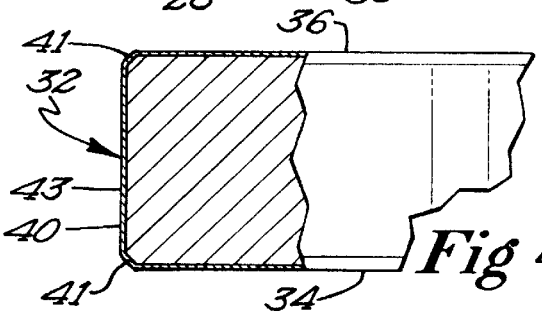
FIG. 4 shows a partial, side elevational view of the magnet of the fastener-keeping accessory of FIG. 1, with portions broken away to show constructional details.
Figure 5:
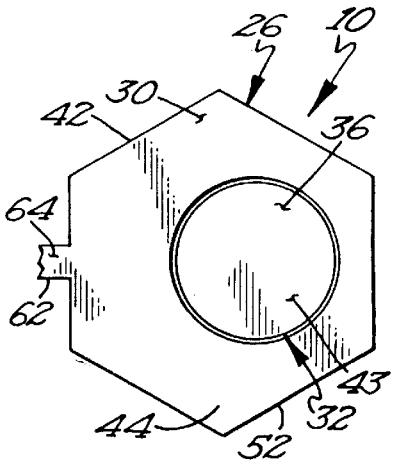
FIG. 5 shows a partial, top plan view of the fastener-keeping accessory of FIG. 1.

Recess 46 and thus magnet 32 received therein are positioned generally concentrically within the peripheries 42 and 142 of disk 26 and thus of well 14. In this regard, recess 46 and magnet 32 can be axially centered in disk 26 as shown in FIGS. 1 and 3. However, recess 46 and thus magnet 32 received therein can be axially offset from the center of disk 26 as shown in FIG. 5. This axial offset is advantageous especially for accessories 10 for keeping burrs 16 of a larger size such as ⅞ inch (2.22 cm) or greater to insure that magnet 32 thereof will engage at least a portion of burr 16 and will not be located concentrically within the center opening of burr 16 and not engage burr 16.

In the preferred form shown, disk 26 includes a pocket 51 extending at a depth from lower wall 50 of recess 46 towards but spaced from face 28 and spaced from peripheries 42 and 142. Pocket 51 has a size smaller than recess 46 and than periphery 40 of magnet 32. In the most preferred form, pocket 51 has a cylindrical shape and is axially centered and particularly is concentrically arranged relative to recess 46.

Disk 26 according to the most preferred teachings of the present invention also includes a vent hole 53 in fluid communication with recess 46. Specifically, in the preferred form shown, vent hole 53 extends from pocket 51 and terminates in face 28 of disk 26 generally concentrically within periphery 142 of portion 54.

In the preferred form, disks 26 are injection molded and in the most preferred form are injection molded in sets 66 including multiple disks 26 each of differing sizes to fit in sockets 12 ranging in size from ⅜ inch (0.95 cm) to ⅞ inch (2.22 cm) or from 10 to 19 millimeters. In particular, the mold for forming disks 26 includes a plurality of cavities corresponding to the number of disks 26 in set 66. The cavities are interconnected by a series of channels, with the channels extending along a straight line and extending from the portions of cavities forming portions 52 of disks 26. In the most preferred form, molten material is not introduced into every cavity but is introduced into only select of the cavities and flows through the channels into other cavities, with at least some of the cavities receiving molten material exclusively from the channels. It can be appreciated that the molten material in the channels results in disks 26 being interconnected in a linear manner by a plurality of strips 62 integrally formed of continuous homogeneous material as disks 26. In the most preferred form, strips 62 have semi-circular cross sections of a constant size. Specifically, strips 62 have planar faces 64 contiguous with faces 30 of disks 26. The thickness of strips 62 is considerably less than the thickness of portions 52 and specifically is of a size which can be manually broken without the use of tools such as by bending or twisting.

According to the teachings of the present invention, magnet 32 is permanently secured to disk 26 within recess 46 by forcing magnets 32 into recesses 46 when disks 26 are at an elevated temperature. In actual practice, sets 66 of disks 26 after molding are heated in an oven 68 or similar heating device having a temperature of approximately 150° F. (65.6° C.) which is considerably below the material melting temperature and deformation softening temperature but sufficient to make the material elastic, pliable and flexible when heated thereby. Sets 66 of disks 26 are removed from oven 68 and positioned with face 28 being horizontal and located vertically below face 30. Magnets 32 are positioned on annular portions 44 of faces 30 generally concentric with recesses 46. At that time, magnets 32 are suitably forced into recesses 46. It should then be appreciated that the construction of accessories 10 and the elevated temperature of disks 26 are particularly advantageous for the fabrication of accessory 10 according to the preferred teachings of the present invention. Specifically, the beveling of magnets 32 at 41 (and the beveling of recesses 46 at 49) helps to cam the material at the corners of faces 30 and side walls 48 outward when magnets 32 are forced into recesses 46. Additionally, nickel-plating 43 of magnets 32 reduces the sliding frictional forces between magnets 32 and the material forming disks 26 to help slipping of magnets 32 into recesses 46. Further, due to the increased elasticity, pliability and flexibility of the material forming disks 26 at its increased temperature, forcing of magnets 32 into recesses 46 causes the material to stretch without generally permanently deforming the material. Thus, after magnets 32 are inserted into recesses 46, the material forming disks 26 attempts to return to its original size and tightly grips peripheries 40 of magnets 32 due to the smaller size of recesses 46 at least at the first portions and in the most preferred form at the entrance into recesses 46. Further, in the most preferred form with recesses 46 having a depth slightly greater than the heights of magnets 32, the corners of the disks 26 between faces 30 and side walls 48 may extend over faces 36 of magnets 32 and act as retaining lips for securing magnets 32 in disks 26. In this regard, bevel 41 between face 36 and periphery 40 of magnet 32 acts as a guide for the material forming disk 26 to extend over the outer edge of face 36. This retaining lip provides extra securement for maintaining magnet 32 in recess 46 and preventing removal therefrom, especially as a result of forces from operation of socket 12 with an impact wrench. It has been found that accessories 10 fabricated according to the preferred teachings of the present invention are very effective in preventing the undesired removal of magnets 32 from disks 26.

Furthermore, as magnets 32 are forced into recesses 46, air has difficulty in escaping between peripheries 40 of magnets 32 and the side walls 48 of recesses 46 and thereby is trapped inside recesses 46 and resists the entry of magnets 32 into recesses 46. According to the teachings of the present invention, air trapped in recesses 46 by magnets 32 as magnets 32 are forced into recesses 46 is able to flow into and be compressed into pockets 51. Thus, pockets 51 generally remove the resistance by trapped air in recesses 46. Furthermore, in the most preferred form shown, air is received and allowed to escape from recess 46 into pocket 51 and through vent hole 53 to the atmosphere so that air within pocket 51 will equalize to atmospheric pressure. The size of vent hole 53 is considerably smaller than face 34, lower wall 50 and the lower wall of pocket 51 but of a size sufficient to allow the passage of air and to prevent entry of outside material and particularly of an object which could engage magnet 32 and unintentionally push magnet 32 from recess 46.

Now that the basic construction of accessory 10 according to the preferred teachings of the present invention has been explained, the operation and subtle features of accessory 10 can be set forth and appreciated. Specifically, when it is desired to initially hold burr 16 captive within well 14 of socket 12, accessory 10 can be positioned adjacent the open end of well 14 with periphery 42 of disk 26 extending over the inner periphery of well 14 and abutting with socket 12. At that time, accessory 10 can be pushed forcing disk 26 to pass into well 14 to compress disk 26 into well 14 with a snug, friction fit. Accessory 10 can be pushed into well 14 until face 28 is adjacent to or abuts with the handle mounting end and closes off the inner end of opening 24 of socket 12.

Due to the mounting of magnet 32 spaced within and from peripheries 42 and 142 of disk 26 and the smaller diameter of magnet 32 than well 14, socket 12 is magnetically insulated from magnet 32 by disk 26. Specifically, due to the nonmagnetic material forming disk 26, disk 26 effectively prevents passage of the magnetic field of magnet 32 to the handle mounting end of socket 12. Thus, although burr 16 positioned within well 14 and abutting with face 36 of magnet 32 will be attracted to and held by magnet 32 within well 14 of socket 12, the magnetic field created within socket 12 itself and the captured burr 16 will not be sufficient to be detrimentally attracted to any metal in the path of socket 12 to the fastening location as well as metal surrounding the fastening location.

Due to the magnetic insulation of magnet 32 by disk 26 except for face 36, the magnetic attraction between burr 16 and face 36 is enhanced. Thus, the strength required for magnet 32 to effectively capture burr 16 within well 14 is minimized, with the attraction of socket 12 to-metal (which is dependent on the strength of magnet 32) also being minimized.

It should be appreciated that sockets 12 are made by various manufacturers and are of various designs and configurations including with varying number of sides 18 forming well 14. However, as sockets 12 of whatever design must correspond to and slideably receive burrs 16 to be operable, the diameter of corners 20 must be generally standard and corresponding to that of burrs 16. Accessory 10 according to the teachings of the present invention takes advantage of this feature to allow use in conventional sockets 12 of whatever design and without modification. Specifically, disk 26 can be sized according to the diameter of corners 20 of the particular sized socket 12 for which accessory 10 is desired to be utilized. Disk 26 can then be pushed into well 14 of socket 12 elastically deforming to match the periphery of well 14 regardless of the number of sides 18 or the diameter of corners 22 of the particular socket 12 which accessory 10 is to be utilized. In fact, as accessory 10 is bound in well 14 by disk 26 deforming around corners 22 and along sides 18, high tolerances are possible between the relationship between the diameters of disk 26 and corners 20 such that accessory 10 can be utilized through a range of socket sizes such as for generally corresponding standard American (inch) or metric sizes.

It should be understood that magnets 32 have to have a minimum mass to have sufficient strength to magnetically hold fastener 16 in well 14. Additionally, the diameter of recess 46 must be smaller than peripheries 42 and 142 of disk 26 to insure sufficient material exists between periphery 40 of magnet 32 and well 14 to magnetically isolate magnet 32 from socket 12 and reduce shock and stress transference to magnet 12. Accessory 10 utilizing disk 26 of the most preferred form shown is then particularly advantageous for use in sockets 12 having shallow wells 14. Particularly, periphery 142 has a size and shape corresponding to and for receipt in connection passage 58 and preferably for slideable receipt in connection passage 58 with a snug fit to assist portion 52 in holding accessory 10 within socket 12 while still allowing accessory 10 to be forced from socket 12 by passing an elongated member through opening 24 and pushing against face 28. However, periphery 142 can be smaller than connection passage 58. Disk 26 can then be pushed into well 14 with face 28 extending into connection passage 58 until shoulder 56 abuts with the end of well 14 and its interconnection to connection passage 58. It can then be appreciated that face 34 of magnet 32 is located in connection passage 58 below well 14. Thus, face 36 of magnet 32 is located deeper in well 14 leaving more room for receipt of fastener 16 in sockets 12 having shallow depths. Additionally, magnet 32 and recess 46 in disk 26 can be made with smaller diameters and longer in length to insure that the radial thickness of disk 26 is sufficient to magnetically isolate magnet 32 from socket 12 and to increase the surface area of recess 46 which engages magnet 32 to reduce shock and stress transference to magnet 32. It can be appreciated that in the event that accessory 10 having disk 26 is utilized in sockets 12 having deep wells 14 of the type shown and specifically typically not including connection passage 58, disk 26 is pushed in well 14 until face 28 abuts with opening 24.

Further, in addition to being usable with any make or model of socket 12 without need for modifying socket 12, accessory 10 can be removed easily from socket 12 by pushing an elongated member through opening 24 thereby forcing accessory 10 from socket 12 and allowing standard use of socket 12. Due to the resilient compressible nature of disk 26 of the most preferred form, disk 26 generally returns to its original shape so that accessory 10 can be inserted into and removed from well 14 a multiplicity of times without detrimentally affecting the utilization of accessory 10.

Prior to the present invention, magnets were typically glued or otherwise adhered to their carriers. Over time, such methods of securement were prone to release due to the aging of such glue or adhesive, the vibration from the application of torque, or the exposure to chemicals such as gasoline, solvents, fuels, or the like in the work area and which have a tendency to break down glues, adhesives or the like. Other approaches of permanently securing the magnets to the carriers, such as shown in U.S. Pat. Nos. 2,806,396 and 5,199,334, involved the use of specially shaped magnets. However, such specially shaped magnets required expensive capital costs resulting in accessories which do not have wide market acceptance believed due to perceived expensive purchase costs. Still other approaches of permanently securing the magnets to the carriers, such as shown in U.S. Pat. No. 5,542,320, utilize a layer secured by its periphery to the carrier and extending over the face of the magnet. However, fabrication of such accessories often required the carrier and layer to be fabricated around the magnets. As the magnets are very heat sensitive, the material and the method of fabrication of the carrier and layer were limited to those which did not detrimentally affect the magnets. Also, it is difficult to fabricate the accessory with the magnet completely enclosed within the carrier and layer. Accessory 10 according to the teachings of the present invention utilizes a construction and method of fabrication allowing disks 26 to be separately formed with magnets 32 of a cylindrical shape and permanently secured to disk 26 by an interfit with a specially shaped recess 46 in disk 26 and without requiring the use of glue, adhesive, or the like between magnet 32 and disk 26. Thus, accessory 10 overcomes the deficiencies which resulted from the use of glue, adhesive, or the like and/or from the fabrication of the carrier at least partially around the magnets. Furthermore, in the most preferred form, the number of steps required in manufacture is also reduced at least due to the elimination of the application step of glues, adhesive, or the like. Further, magnets 32 of accessory 10 of the preferred form of the present invention is of a standard variety not requiring expensive capital costs for their fabrication.

It should be noted that shock or pounding forces can result in chipping, demagnetization, or other damage to magnet 32. In addition to removably positioning magnet 32 into and magnetically insulating magnet 32 from socket 12, disk 26 takes up and absorbs vibration resulting from use of pneumatic tools in applying torque to socket 12 to fasten or loosen burr 16. It should be further noted that the air received in pocket 51 acts as a cushion between magnet 32 and disk 26 to reduce damage to magnet 32 and thus extend its useful life. Additionally, due to the general inability of magnetic fields from passing through air, the air received in pocket 51 and extending over face 34 of magnet 32 is believed to be advantageous in magnetically isolating magnet 32 from socket 12.

In the most preferred form, accessory 10 has a thickness such that burr 16 or the head of a bolt or similar fastener of a standard size extends beyond well 14 and out of socket 12 such as in the range of one-sixteenth inch (1.6 mm) to allow ease of removal of burr 16 from well 14 while still insuring that burr 16 extends sufficiently in well 14 to prevent relative rotation therebetween. Additionally, due to the snug fit, accessory 10 is slideably adjustable inside of well 14 to positions spaced from the handle mounting end of socket 12 so that burr 16 or similar fastener of a thinner size extends beyond well 14 and out of socket 12 to allow ease of removal of burr 16 from well 14. Specifically, accessory 10 can be adjustably positioned in well 14 by passing an elongated member through opening 24 and pushing against face 28 to slide accessory 10 to the desired position inside of well 14.

In the most preferred form, strips 62 retain all disks 26 for a standard set of sockets 12 together for ease of handling. Specifically, in the preferred form, multiple, interconnected disks 26 are molded together in sets 66 and can be removed from the mold as a single unit. Then the single unit set 66 can be transported to oven 68 or similar heated environment and to a jig where magnets 32 are simultaneously forced into each disk 26. Then set 66 of accessories 10 can be placed as a single unit into suitable packaging, with accessories 10 being allowed to cool to ambient temperatures before or after packaging. The customer can remove set 66 from the packaging and can separate the individual accessories 10 for placement in the respective size sockets 12 by manually breaking strips 62 such as by bending or twisting strips 62 between disks 26.

Now that the basic teachings of the present invention have been explained, many extensions and variations will be obvious to one skilled in the art. For example, although in the most preferred form several unique and novel features have been utilized producing synergistic results, such features could be utilized separately or in other combinations according to the teachings of the present invention. As an example, in the most preferred form shown, disk 26 includes both pocket 51 and vent hole 53 which is believed to be particularly advantageous. However, accessory 10 according to the preferred teachings of the present invention could include only one of these features. Specifically, pocket 51 according to the teachings of the present invention could be provided without vent hole 53 resulting in air being received and trapped in pocket 51 which could enhance the cushion and/or magnetic isolation effect provided by the air in pocket 51. Alternately, vent hole 53 according to the teachings of the present invention could be provided without pocket 51 and of sufficient size so that air is not trapped within recess 46 after the insertion of magnet 32. Vent hole 53, especially if provided without pocket 51, can be provided at a variety of locations to allow the escape of air from recess 46 as magnet 32 is forced into recess 46.

Likewise, although the operation of accessory 10 of the above invention was described with reference to a nut or burr 16, it can be appreciated that accessory 10 can be utilized to capture the head of a bolt or other fasteners within well 14 of socket 12. Further, although the operation of accessory 10 of the above invention was described with reference to fastening fastener 16, it can be appreciated that accessory 10 can be utilized to capture fastener 16 when removing fastener 16 from the fastening location.

Also, although heating of disks 26 was described as occurring in oven 68 or similar heating device, it can be appreciated that magnets 32 could be forced into recesses 46 after their removal from the injection molds and while disks 26 are at the desired elevated temperature and before they are allowed to cool to ambient temperature so that a separate step of heating disks 26 is not required.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Accessory for use in wrench sockets without need for modifying the wrench sockets, with the wrench sockets each being of a conventional design including a well having an inner periphery formed by multiple sides intersecting at outer corners and including a handle mounting end, with the well slideably receiving a fastener, comprising, in combination: at least first and second, nonmagnetic, compressible disks each including opposed, first and second faces and a periphery having at least portions of a size greater than the inner periphery of the well; with each of the disks including a generally cylindrical magnet secured to the disk and having opposed, first and second faces and a periphery smaller than the inner periphery of the well, with the disk being elastically deformable under force to pass into and snugly fit within the inner periphery of the well with the magnet positioned on the opposite side of the disk than the handle mounting end of the socket with the disk magnetically insulating the magnet from the socket; and a strip integrally extending between the first and second disks, with the strip and the first and second disks being formed of homogeneous material, with the strip having a thickness which is considerably less than the thickness of the disks between the first and second faces and having a size which can be manually broken, wherein the strip has a first face which is contiguous with the second faces of the disks, and wherein the strip has semicircular cross sections.

2. The accessory of claim 1 wherein each disk further includes a recess extending at a depth from the second face of the disk towards but spaced from the first face of the disk and spaced from the periphery of the disk, with the generally cylindrical magnet being received in the recess of the disk.

3. The accessory of claim 2 wherein each of the disks includes a first portion integrally attached to a second portion, with the first portion including the second face, with the periphery of the first portion of the disk being of a size at least equal to the inner periphery of the well, with the second portion including the first face, with the periphery of the second portion of the disk having a diameter less than the first portion.

4. The accessory of claim 3 wherein the strip extends between the first portions of the disks, with the thickness of the strip being considerably less than the thickness of the first portion.

5. Accessory for use in a wrench socket without need for modifying the wrench socket, with the wrench socket being of a conventional design including a well having an inner periphery formed by multiple sides intersecting at outer corners and including a handle mounting end, with the well slideably receiving a fastener, with the accessory preventing the fastener from sliding from the well to hold the fastener captive in the well while the socket is being moved to the fastening location, comprising, in combination: a generally cylindrical magnet having planar, parallel, opposed, first and second faces and a periphery smaller than the inner periphery of the well; and a nonmagnetic, compressible disk including opposed, first and second faces, a periphery having at least portions of a size greater than the inner periphery of the well, and a recess for receipt of the magnet and extending at a depth from the second face of the disk towards but spaced from the first face of the disk and spaced from the periphery of the disk, with the disk being elastically deformable under force to pass into and snugly fit within the inner periphery of the well with the magnet positioned on the opposite side of the disk than the handle mounting end of the socket with the disk magnetically insulating the magnet from the socket, with the periphery of the magnet having a generally constant size between the first and second faces of the magnet, with the recess formed by a side wall extending from the second face of the disk and terminating in a lower wall located intermediate the first and second faces of the disk, with the side wall having a first portion of a size smaller than the generally constant size of the periphery of the magnet for holding the magnet in the recess without requiring the use of glue or adhesive.

6. The accessory of claim 5 wherein the recess has an increasing size from the first portion with increasing spacing from the second face of the disk.

7. The accessory of claim 6 wherein the first portion is located generally contiguous with the second face of the disk.

8. The accessory of claim 7 wherein the recess is frustoconical in shape having an increasing cross-sectional size from the second face towards the first face of the disk.

9. The accessory of claim 5 wherein the disk is formed of polyethylene which can be heated allowing the disk to stretch for receipt of the magnet by being forced into the recess.

10. The accessory of claim 5 wherein the magnet is beveled at least at the corner between the periphery and the first face for camming the disk outward when the magnet is forced into the recess.

11. The accessory of claim 5 wherein the magnet is plated with a material which reduces the sliding frictional forces between the magnet and the disk as the magnet is forced into the recess and which retards rusting of the magnet.

12. The accessory of claim 5 further comprising, in combination: means extending from the recess for receiving air trapped in the recess as the magnet is forced into the recess.

13. The accessory of claim 5 further comprising, in combination: at least one additional nonmagnetic, compressible disk; and a strip integrally extending between the disk and the additional disk, with the strip, the disk, and the additional disk being formed of homogeneous material, with the strip having a size which can be manually broken.

14. The accessory of claim 13 wherein the strip has a first face which is contiguous with the second faces of the disks.

15. The accessory of claim 14 wherein the strip has semi-circular cross sections of a constant size.

16. The accessory of claim 5 wherein the depth of the recess is slightly greater than the height between the first and second faces of the magnet so that the corner of the disk between the second face and the side wall extends over the second face of the magnet to act as a retaining lip.

17. Accessory for use in a wrench socket without need for modifying the wrench socket, with the wrench socket being of a conventional design including a well having an inner periphery formed by multiple sides intersecting at outer corners and including a handle mounting end, with the well slideably receiving a fastener, with the accessory preventing the fastener from sliding from the well to hold the fastener captive in the well while the socket is being moved to the fastening location, comprising, in combination: a generally cylindrical magnet having opposed, first and second faces and a periphery smaller than the inner periphery of the well; and a nonmagnetic, compressible disk including opposed, first and second faces, a periphery having at least portions of a size greater than the inner periphery of the well, a recess for receipt of the magnet and extending at a depth from the second face of the disk towards but spaced from the first face of the disk and spaced from the periphery of the disk, and means extending from the recess for receiving air trapped in the recess as the magnet is forced into the recess, with the disk being elastically deformable under force to pass into and snugly fit within the inner periphery of the well with the magnet positioned on the opposite side of the disk than the handle mounting end of the socket with the disk magnetically insulating the magnet from the socket.

18. The accessory of claim 15 wherein the air receiving means comprises a pocket extending at a depth from the recess towards but spaced from the first face of the disk and spaced from the periphery of the disk, with the pocket being of a size smaller than the recess and than the periphery of the magnet for compression of air as the magnet is forced into the recess.

19. The accessory of claim 16 wherein the air receiving means further comprises, in combination: a vent hole in fluid communication with the recess for allowing air trapped in the recess as the magnet is forced into the recess to escape to the atmosphere.

20. The accessory of claim 15 wherein the air receiving means comprises a vent hole in fluid communication with the recess for allowing air trapped in the recess as the magnet is forced into the recess to escape to the atmosphere.

21. Accessory for use in a wrench socket without need for modifying the wrench socket, with the wrench socket being of a conventional design including a well having an inner periphery formed by multiple sides intersecting at outer corners and including a handle mounting end, with the well slideably receiving a fastener, with the accessory preventing the fastener from sliding from the well to hold the fastener captive in the well while the socket is being moved to the fastening location, comprising, in combination: a magnet having opposed, first and second faces and a periphery smaller than the inner periphery of the well; and a nonmagnetic, compressible disk including opposed, first and second faces and including a periphery having at least portions of a size greater than the inner periphery of the well, with the magnet secured to the disk spaced from the periphery of the disk and axially offset from the center of the periphery of the disk with the disk being elastically deformable under force to pass into and snugly fit within the inner periphery of the well with the magnet positioned on the opposite side of the disk than the handle mounting end of the socket with the disk magnetically insulating the magnet from the socket and with the magnet positioned generally nonconcentrically within the inner periphery of the well.

22. The accessory of claim 21 wherein the magnet is secured to the disk by a recess formed in the disk for receipt of the magnet and extending at a depth from the second face of the disk towards but spaced from the first face of the disk and spaced from the periphery of the disk.

* * * * *

UNITED STATES PATENT AND TRADEMARK OFFICE

CERTIFICATE OF CORRECTION

PATENT NO. : 6,006,630

DATED : December 28, 1999

INVENTOR(S) : Richard A. Vasichek, et. al.

It is certified that error appears in the above-identified patent and that said Letters Patent is hereby corrected as shown below:

Column 12, line 52, cancel "15" and substitute therefor -- 17 --.

Column 12, line 59, cancel "16" and substitute therefor -- 18 --.

Column 12, line 64, cancel "15" and substitute therefor -- 17 --.

Signed and Sealed this

Twenty-fourth Day of October, 2000

*Attest:*

Q. TODD DICKINSON

*Attesting Officer*

*Director of Patents and Trademarks*